US008038470B2

(12) United States Patent
Westman et al.

(10) Patent No.: US 8,038,470 B2
(45) Date of Patent: Oct. 18, 2011

(54) CONNECTOR ASSEMBLY FOR A COMPRESSIBLE GASKET

(75) Inventors: John Eugene Westman, Harrisburg, PA (US); Jared Evan Rossman, Dover, PA (US); Karen Paul Seubert, Camp Hill, PA (US); Paul Walter McDowell, Fishers, IN (US); Andrew Charles Davison, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 110 days.

(21) Appl. No.: 12/544,655

(22) Filed: Aug. 20, 2009

(65) Prior Publication Data

US 2011/0045692 A1 Feb. 24, 2011

(51) Int. Cl.
*H01R 13/73* (2006.01)

(52) U.S. Cl. ..... 439/556; 174/153 G

(58) Field of Classification Search ..... None
See application file for complete search history.

(56) References Cited

U.S. PATENT DOCUMENTS

| | | | | | |
|---|---|---|---|---|---|
| 2,169,964 | A | * | 8/1939 | Murphy | 439/556 |
| 2,645,736 | A | * | 7/1953 | Dickson | 313/318.04 |
| 3,056,852 | A | * | 10/1962 | Sachs | 174/153 G |
| 3,244,802 | A | * | 4/1966 | Sturtevant et al. | 174/153 G |
| 3,415,549 | A | * | 12/1968 | Chatham | 403/197 |
| 3,899,658 | A | * | 8/1975 | Yartz | 219/536 |
| 4,033,535 | A | * | 7/1977 | Moran | 248/56 |
| 4,797,513 | A | * | 1/1989 | Ono et al. | 174/153 G |
| 5,499,823 | A | * | 3/1996 | Fukui | 277/314 |
| 5,531,459 | A | * | 7/1996 | Fukuda et al. | 277/606 |

* cited by examiner

*Primary Examiner* — Michael Zarroli

(57) ABSTRACT

A connector assembly for use with a compressible gasket includes a housing having a mating end and a cable end, the housing being configured to hold a contact. The connector assembly also includes a deflectable shroud extending from the housing rearward of the cable end to the compressible gasket. The shroud surrounds a hollow chamber that is configured to receive the compressible gasket. The shroud is deflectable between an expanded state and a collapsed state, wherein a volume of the hollow chamber is reduced when in the collapsed state as compared to the expanded state. The shroud compresses the gasket when in the collapsed state.

20 Claims, 8 Drawing Sheets

CONNECTOR ASSEMBLY FOR A COMPRESSIBLE GASKET

BACKGROUND OF THE INVENTION

The subject matter herein relates generally to connector assemblies, and more particularly, to connector assemblies for compressible gaskets.

Cable mounted connector assemblies are known and in wide use in many different applications. The connector assemblies may be routed through structures and extend through a wall or panel of the structure to a desired location. One such example of an application that utilizes connector assemblies is in the appliance industry. The connector assemblies are routed through a wall of the appliance through an opening in one of the panels of the wall. For example, a power connector assembly may be routed within a wall of a refrigerator, through an opening in an interior panel of the refrigerator.

Typically, the connector assembly is mounted within the opening of the panel such that a mating end of the connector assembly is accessible for mating with a mating connector. A cable end of the connector assemble is positioned on the opposite side of the panel. However, such arrangements are not without disadvantages. For example, the interior of the refrigerator wall is typically filled with an expandable foam to insulate the wall. The expandable foam is flammable, and thus should be isolated from the metal wires or contacts of the connector assembly. With the cable end on the inside of the panel wall, the expandable foam is in direct contact with the cable end, and is susceptible to igniting from a spark, short or excessive heating of the wires or contacts.

One solution to such arrangements is to bring the connector assembly entirely through the wall such that the connector is not in direct contact with the expandable foam. A plastic grommet may be positioned within the opening to provide a port for the cables to extend through. The grommet protects the cable from being damaged or cut on the panel opening. However, because the cable is typically smaller than the connector itself, the opening in the grommet is usually larger than the diameter of the cable(s). As such, a gap or space is present between the grommet and the cable(s). The expandable foam may leak through the gap or space. Such leaking is undesirable as it is unsightly and may cause the foam to come into contact with exposed portions of the cable(s) or the contacts, which may be hazardous.

One known solution to the problems associated with using the plastic grommets is to use a compressible gasket, such as a sponge-like or foam-like gasket. However, difficulties arise in mounting the gasket to the panel. Problems also arise in mounting the connector assembly to the gasket. A need remains for a connector assembly that may be used with compressible gaskets.

BRIEF DESCRIPTION OF THE INVENTION

In one embodiment, a connector assembly for use with a compressible gasket is provided, where the connector assembly includes a housing having a mating end and a cable end, the housing being configured to hold a contact. The connector assembly also includes a deflectable shroud extending from the housing rearward of the cable end to the compressible gasket. The shroud surrounds a hollow chamber that is configured to receive the compressible gasket. The shroud is deflectable between an expanded state and a collapsed state, wherein a volume of the hollow chamber is reduced when in the collapsed state as compared to the expanded state. The shroud compresses the gasket when in the collapsed state.

Optionally, the shroud may have a forward end and a rearward end, wherein the forward end is connected to the housing and the rearward end is configured to engage the gasket. The shroud may pivot about the forward end to change a relative position of the rear end. When in the expanded state, the rear end may define a height that is taller than the forward end, and when in the collapsed state, the rear end may define a height that is substantially the same as the forward end. Optionally, the shroud may include a first wing and a second wing, where the first wing is movable relative to the second wing to increase or decrease the volume of the hollow chamber. The connector assembly and the gasket may be loaded through an opening in a panel that has a perimeter that is smaller than a perimeter of the shroud, such that the shroud is deflected to the collapsed state when the shroud passes through the opening, and such that the shroud compresses the gasket when the shroud passes through the opening.

In another embodiment, a connector assembly is provided for use with a compressible gasket that includes a housing having a mating end and a cable end, the housing being configured to hold a contact. A deflectable shroud extends from the housing rearward of the cable end to the compressible gasket. The shroud surrounds a hollow chamber configured to receive the compressible gasket. The shroud has a first wing and a second wing, where the first wing is movable with respect to the second wing to increase or decrease a volume of the hollow chamber. The shroud is able to compress the gasket when the first wing is moved relatively closer to the second wing.

In a further embodiment, a method is provided of mounting a connector assembly to a panel having an opening. The method includes the steps of providing a compressible gasket having a channel therethrough, providing a connector housing with a deflectable shroud extending from the connector housing that defines a hollow chamber, and positioning the gasket within the hollow chamber and collapsing the shroud onto the gasket. The method also includes loading the connector housing and gasket through the opening in the panel, wherein the shroud is collapsed as the shroud passes through the panel opening, and wherein the shroud compresses the compressible gasket as the shroud is collapsed. The connector housing and gasket are loaded through the opening until the gasket is aligned with the opening.

DETAILED DESCRIPTION OF THE INVENTION

Figure 1:
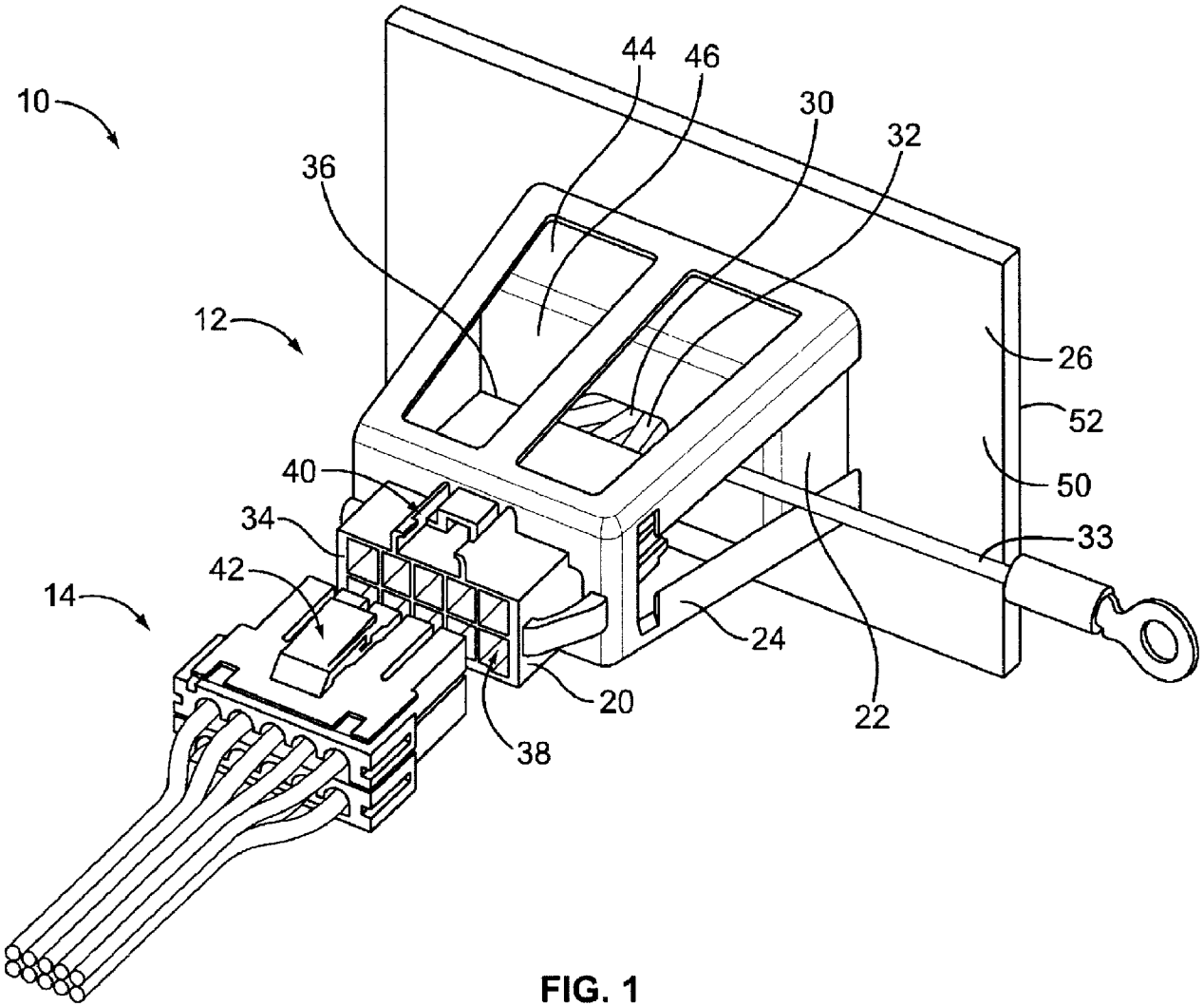
FIG. 1 is a front perspective view of a connector system having a connector assembly formed in accordance with an exemplary embodiment.

FIG. 1 is a front perspective view of a connector system 10 having a connector assembly 12 formed in accordance with an exemplary embodiment. The connector assembly 12 mates with a mating connector 14. In the illustrated embodiment, both the connector assembly 12 and the mating connector 14 are cable mounted, however alternative connectors are possible in alternative embodiments, such as board mounted connectors. In an exemplary embodiment, the connector system 10 is part of an appliance, such as a refrigerator. The connector system 10 supplies power to various elements within the appliance, examples include, but are not limited to, the lighting system, the filtration system, and the like.

The connector assembly 12 includes a connector housing 20, a compressible gasket 22 and a deflectable shroud 24 that extends between the connector housing 20 and the compressible gasket 22. The connector assembly 12 is mounted to a wall or panel 26, and thus defines a panel mounted connector assembly. The connector assembly 12 extends through an opening 28 (shown in FIG. 3) in the panel 26 such that the connector assembly 12 is positioned on an exposed side of the panel 26 for mating with the mating connector 14. The shape of the opening 28 may be non-uniform, thus defining a polarizing feature. In such cases, the connector assembly 12 may only fit into the opening 28 in one orientation. For example, the connector assembly 12 may have a similar non-uniform shape as the opening 28. For example, the shroud 24 may have a non-rectangular shape to allow only one loading orientation.

The connector assembly 12 is mounted to an end of a cable 30, where individual wires 32 of the cable 30 extend through the gasket 22 to the connector housing 20. In an exemplary embodiment, contacts (not shown) are terminated to the ends of the individual wires 32 and are held within the connector housing 20. The contacts are mated with corresponding mating contacts (not shown) of the mating connector 14. In an exemplary embodiment, the connector assembly 12 represents a power connector, however the connector assembly 12 is not limited to such applications. In an exemplary embodiment, the connector assembly 12 includes a ground wire 33 extending from the connector housing 20 for electrically grounding the connector assembly 12. The ground wire 33 extends through the shroud 24. Optionally, other wires may extend through the shroud 24. The wires may extend through the gasket 22 and then out through the shroud 24.

The connector housing 20 includes a mating end 34 and a cable end 36. The mating connector 14 is mated to the mating end 34. The cable 30 extends rearward from the cable end 36 through the gasket 22. The connector housing 20 includes individual contact channels 38 that receive individual contacts, such as socket contacts or pin contacts. The connector housing 20 includes a latching feature 40 that interacts with a latching feature 42 of the mating connector 14 to securely couple the mating connector 14 to the connector housing 20. In the illustrated embodiment, the latching feature 40 constitutes a catch while the latching feature 42 constitutes a latch. Other types of latching features or fastening means may be used in alternative embodiments.

The gasket 22 is made from a compressible material, such as a foam material or another material that is deformable, that has compressing and expanding characteristics. The gasket 22 includes an outer perimeter 44 that extends between a front end 46 and a rear end 48 (shown in FIG. 3). The gasket 22 may be box-shaped having curved edges, as in the illustrated embodiment. Alternatively, the gasket 22 may have other shapes depending on the particular application. Optionally, the shape of the gasket 22 is similar to the shape of the opening 28 through the panel 26, however, the gasket 22 is larger than the opening 28 such that the gasket 22 fills the opening 28. The front end 46 may be tapered. The gasket 22 is compressed to fit through the opening 28 and then expands to fill the opening 28. In an exemplary embodiment, the gasket 22 is larger than the opening 28 such that the gasket 22 is compressed by the opening 28 to provide an interference fit with the opening 28. As such, the gasket 22 is securely held within the opening 28 by the interference between the outer perimeter 44 and the opening 28. Additionally, with the gasket 22 being larger than the opening 28, the gasket 22 substantially entirely fills the opening 28 and provides a seal for the opening 28.

The gasket 22 is loaded through the opening 28 such that portions of the gasket 22 are positioned on either side of the panel 26. For example, the front end 46 is positioned forward of, and spaced apart from, a first side 50 of the panel 26, and the rear end 48 is positioned rearward of, and spaced apart from, a second side 52 of the panel 26. In an exemplary embodiment, in the example of the refrigerator, the first side 50 represents an exposed surface of an interior wall of the refrigerator while the second side 52 represents an inner surface of the wall, against which the expandable foam is situated. The wires 32 are passed through the gasket 22 from the interior of the wall to the exterior of the wall through the panel 26.

The deflectable shroud 24 extends between the connector housing 20 and the gasket 22. The shroud 24 functions as a cover for a portion of the gasket 22. The shroud 24 is coupled to the connector housing 20 and engages the gasket 22. In an exemplary embodiment, the shroud 24 functions as a supporting structure for the connector housing 20 and holds the connector housing 20 relative to the panel 26 for mating with the mating connector 14. The shroud 24 prevents the connector housing 20 from backing up relative to the panel 26 and generally holds the connector housing 20 in place. The shroud 24 may provide adequate support for the connector housing 20 for one handed mating with the mating connector 14, wherein the operator does not need to hold the connector housing 20 during mating. Optionally, the shroud 24 may be marked with an identification mark or may be color coded to identify the type or size of the connector assembly 12.

Figure 2:
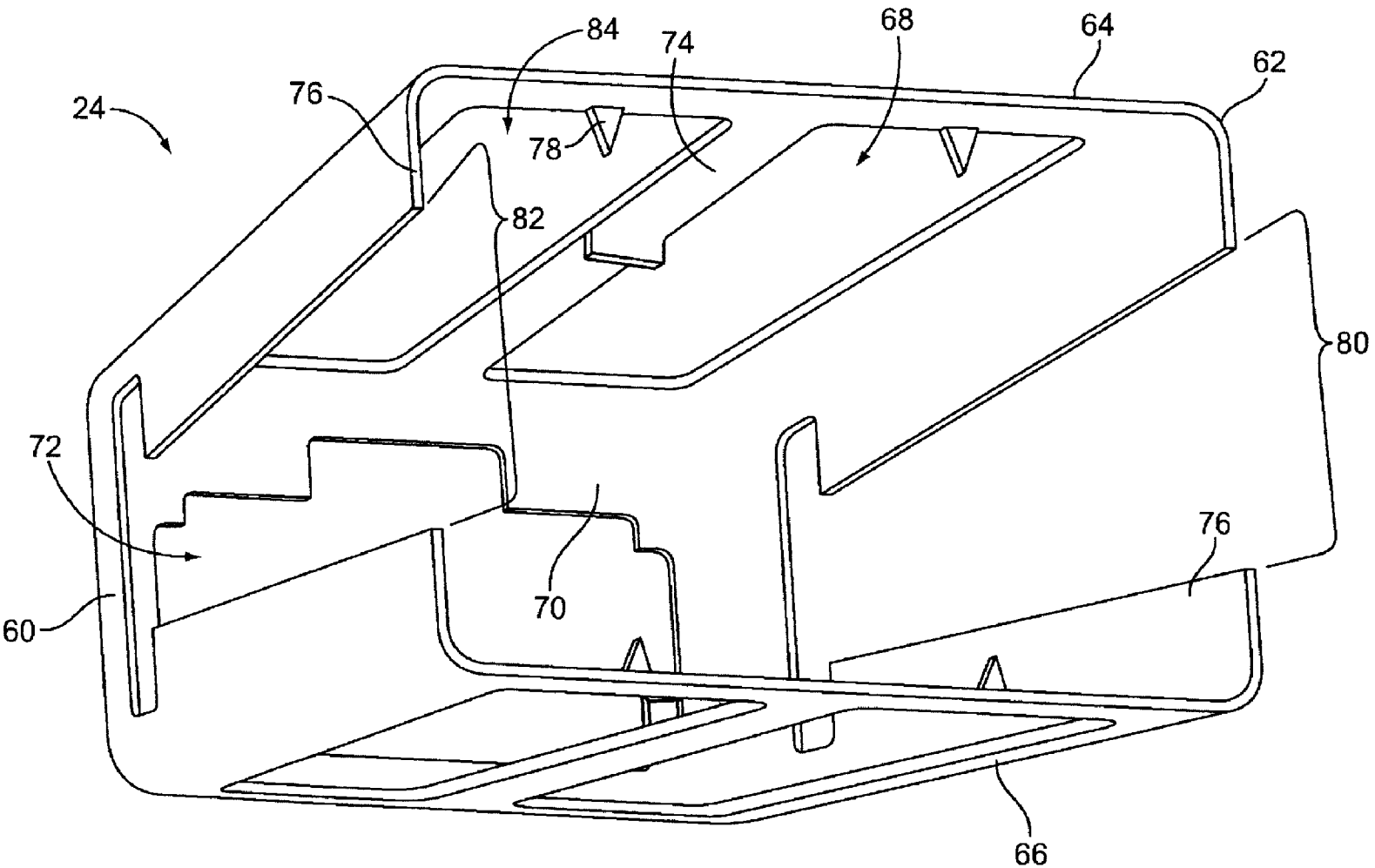
FIG. 2 is a rear perspective view of a deflectable shroud for the connector assembly shown in FIG. 1.

FIG. 2 is a rear perspective view of the deflectable shroud 24 for the connector assembly 12 (shown in FIG. 1). The shroud 24 is deflectable between an expanded state and a collapsed state. The shroud 24 has a smaller outer perimeter in the collapsed state as compared to the expanded state. The shroud 24 is normally in the expanded state and is deflected to the collapsed state during loading of the connector assembly 12 through the panel 26 (shown in FIG. 1). Once the shroud 24 passes through the panel 26 and/or other forces are not holding the shroud 24 in the collapsed state, the shroud 24 returns to the expanded state. The shroud 24 may be manufactured from a material that has elastic characteristics to return to a non-deflected position, such as a metal material or a plastic material.

The shroud 24 has a frame that extends between a forward end 60 and a rearward end 62. In an exemplary embodiment, the shroud 24 includes a first wing 64 and a second wing 66 that are movable relative to one another. A hollow chamber 68 is defined by the shroud 24 between the first and second wings 64, 66 and between the forward and rearward ends 60, 62. A portion of the connector housing 20 (shown in FIG. 1) and a portion of the gasket 22 (shown in FIG. 1) are received within the hollow chamber 68. Alternatively, the shroud 24 may extend rearward from the connector housing 20 such that the connector housing 20 is not disposed in the hollow chamber 68, but rather is entirely forward of the hollow chamber 68.

In an exemplary embodiment, the first and second wings 64, 66 are both connected to a base 70 at the forward end 60.

The first and second wings 64, 66 are cantilevered from the base 70 such that the first and second wings 64, 66 are free floating at the rearward end 62. The base 70 is a wall having an opening 72 that receives the connector housing 20. The shape of the opening 72 corresponds to an outer perimeter of the connector housing 20 such that the base 70 may be coupled to the connector housing 20. Optionally, the base 70 and the opening 72 may be sized and shaped to be fit to a particular type of connector housing 20. As such, the shroud 24 may be retrofit to such connector housing 20. The base 70 and opening 72 may be sized and shaped differently in alternative embodiments to accommodate different types of connector housings 20. In an exemplary embodiment, the first and second wings 64, 66 are integrally formed with the base 70. Alternatively, the first and/or second wings 64, 66 may be separate and discrete components from the base 70 that are coupled to the base 70. In another alternative embodiment, the first and second wings 64, 66 may be separate and discrete components from one another and coupled directly to the connector housing 20 without the use of a base. In such an embodiment, the first and/or second wings 64, 66 may be movable relative to the connector housing 20, such as pivotably coupled to the connector housing 20.

The first and second wings 64, 66 each include a plate 74 and side walls 76 extending generally perpendicular from the plate 74. The plates 74 are connected to the base 70. The plates 74 are oriented on opposite sides of the shroud 24 from one another. In an exemplary embodiment, the plates 74 define a top and a bottom of the shroud 24. Optionally, as in the illustrated embodiment, the first and second wings 64, 66 may have retention barbs 78 that extend inward from the plates 74 into the hollow chamber 68. The retention barbs 78 are configured to engage the gasket 22 when the connector assembly 12 is assembled. In the illustrated embodiment, the retention barbs 78 represent pointed spikes that are configured to bite or dig into the gasket 22.

The first and second wings 64, 66 are separated from one another by gaps 80, 82 that extend between the side walls 76. The gaps 80, 82 are open at the rearward end 62. In the illustrated embodiment, the gaps 80, 82 are generally T-shaped, but the gaps 80, 82 may have other shapes in alternative embodiments. The size of the gaps 80, 82 change as the shroud 24 is deflected between the expanded and collapsed states. For example, the gaps 80, 82 narrow as the shroud 24 is deflected to the collapsed state. The first and second wings 64, 66 may be pivoted about the base 70 to narrow the gaps 80, 82, with the gaps 80, 82 being further narrowed closer to the rearward end 62.

The first and second wings 64, 66 include windows 84 therethrough allowing visual inspection of the hollow chamber 68. For example, the wires 32 (shown in FIG. 1) may be inspected through the windows 84 for damage and/or proper positioning of the contacts within the connector housing 20. Additionally, wires, such as the ground wire 33 (shown in FIG. 1) may pass through the one of the windows 84.

Figure 3:
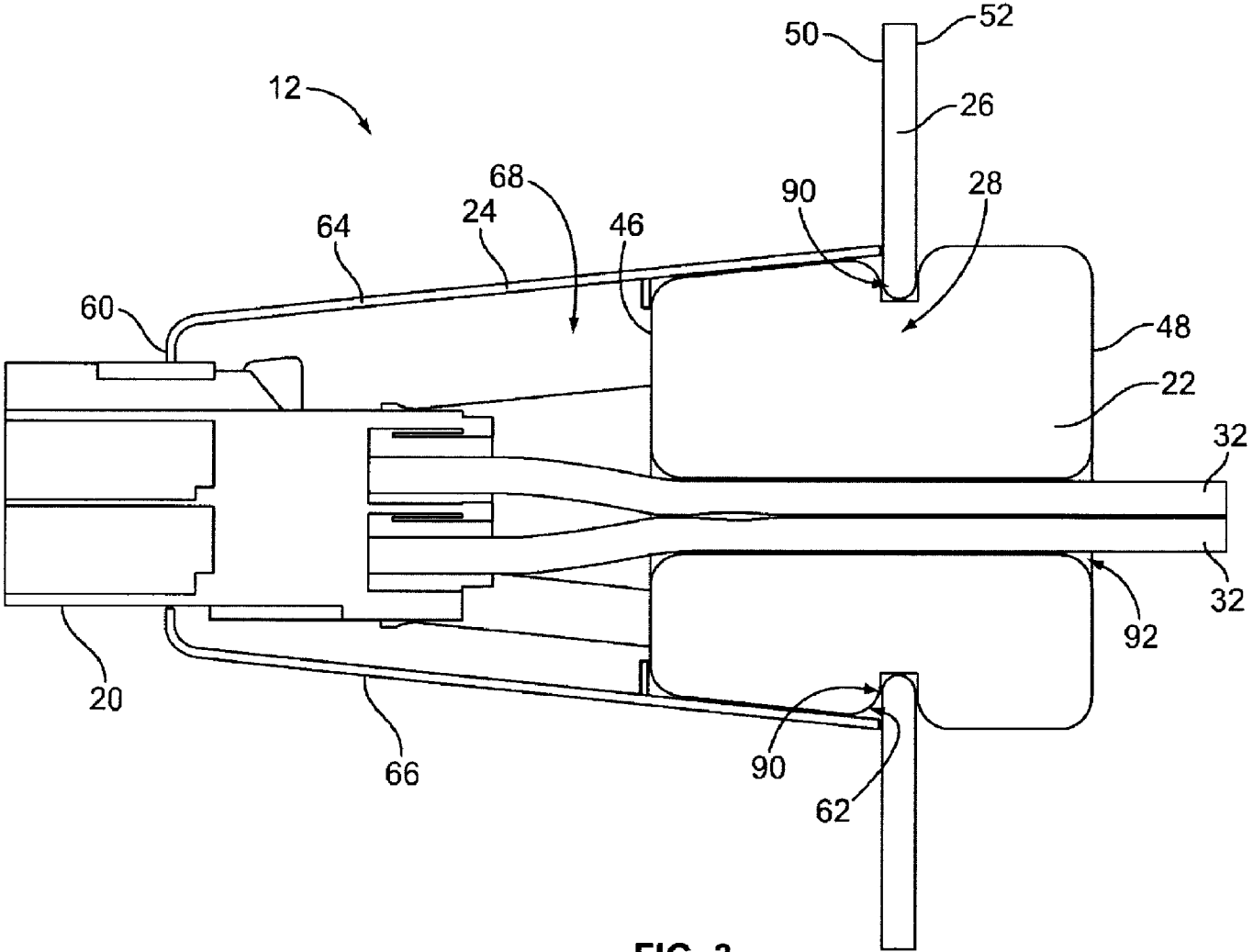
FIG. 3 is a cross-sectional view of the connector assembly shown in FIG. 1 in an expanded state.
Figure 4:
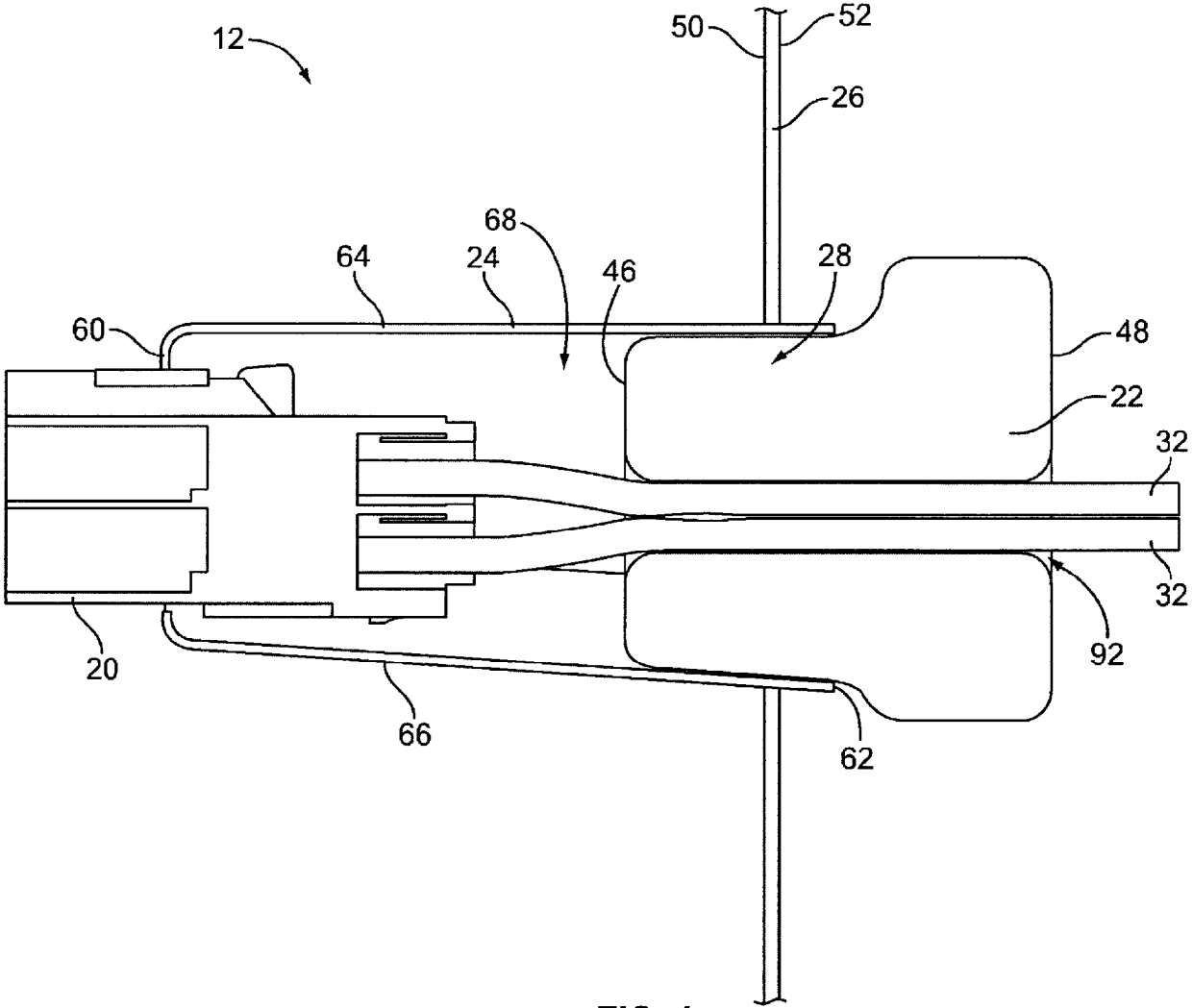
FIG. 4 is a cross-sectional view of the connector assembly shown in FIG. 1 in a collapsed state.

FIG. 3 is a cross-sectional view of the connector assembly 12 in an expanded state. FIG. 4 is a cross-sectional view of the connector assembly 12 in a collapsed state. During assembly, the connector assembly 12 is loaded through the opening 28 until the connector housing 20 and the shroud 24 are positioned forward of the panel 26. The shroud 24 functions as a cover for the gasket 22 and guides the gasket 22 into the opening 28. Optionally, the shroud 24 may snap back into the expanded state as soon as the shroud 24 clears the opening 28. Such snap action may provide an audible or tactile indication of proper positioned of the shroud 24 and the gasket 22.

FIG. 4 shows the connector assembly 12 being loaded through the opening 28. During loading, the shroud 24 is deflected to the collapsed state by interaction with the opening 28. In the collapsed state, the shroud 24 compresses the front end 46 of the gasket 22 so that the front end 46 is able to be squeezed through the opening 28. The shroud 24 thus functions as a lead-in feature for loading the gasket 22 into the opening 28. Once the shroud 24 passes through the opening 28, the shroud 24 returns to the expanded state and the connector assembly 12 is coupled to the panel 26. The gasket 22 is also able to return to an expanded condition when the shroud 24 is deflected to the expanded state.

In the assembled state, the gasket 22 is partially loaded through the opening 28 such that the gasket 22 is aligned with the opening 28. A forward portion of the gasket 22 is positioned forward of the first side 50 and a rearward portion of the gasket 22 is positioned rearward of the second side 52. An interface 90 of the gasket 22 engages the panel 26. The interface 90 is compressed, with the gasket 22 exerting an outward force on the panel 26. The gasket 22 is securely attached to the panel 26 at the interface 90. Because the gasket 22 is at least partially compressed at the interface 90, the gasket 22 exerts an inward force onto the wires 32 generally radially inward from the interface 90. Such force helps hold the wires 32, such as to provide strain relief, and may also ensure that a channel 92 holding the wires 32 is sealed against the wires 32.

In the assembled state, the rearward end 62 abuts against the first side 50 of the panel 26. Such interaction supports the shroud 24 relative to the panel 26. The shroud 24 also supports the connector housing 20 and holds the connector housing 20 for mating with the mating connector 14 (shown in FIG. 1).

As shown in FIGS. 3 and 4, a volume of the hollow chamber 68 is changed as the shroud 24 is transitioned between the expanded state and the collapsed state. Such transition compresses the gasket 22 so that the gasket 22 can fit through the opening 28 in the panel 26. Based on the size of the opening 28 and the size of the gasket 22, considerable compression may be necessary. Optionally, the hollow chamber 68 may be reduced in volume by at least 10% as the shroud 24 is deflected to the collapsed state. In the illustrated embodiment, in the expanded state, the hollow chamber 68 is generally pie-shaped, with the rearward end 62 being wider than the forward end 60. The first and second wings 64, 66 are angled outward from a central longitudinal axis of the connector assembly 12. In the collapsed state, the hollow chamber 68 is generally box-shaped, with the rearward end 62 being approximately the same width as the forward end 60. The first and second wings 64, 66 are generally parallel to one another and parallel to the central longitudinal axis of the connector assembly 12. Other configurations of expanded and collapsed states are possible in alternative embodiments.

Figure 5:
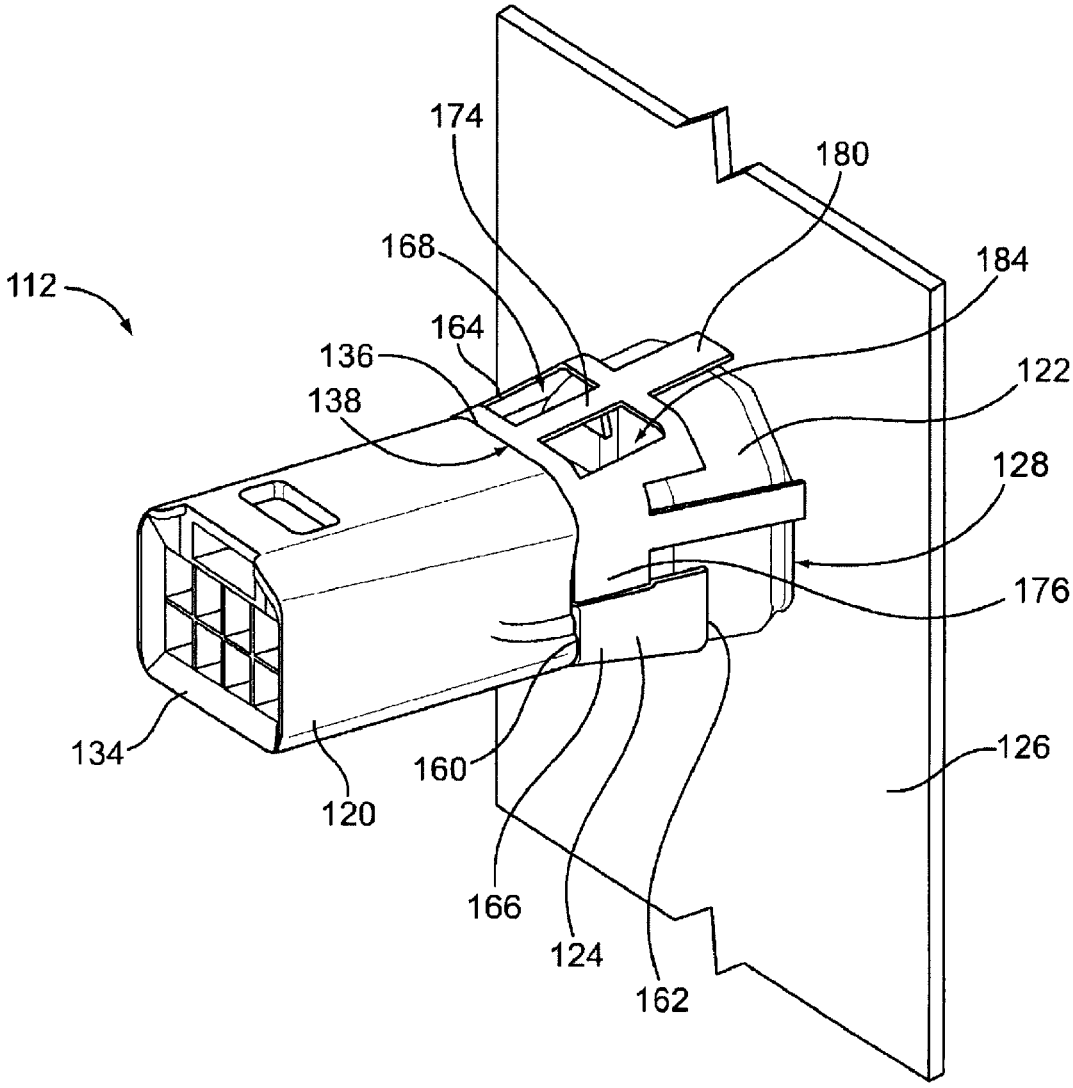
FIG. 5 is a front perspective view of an alternative connector assembly.

FIG. 5 is a front perspective view of an alternative connector assembly 112. The connector assembly 112 includes a connector housing 120, a compressible gasket 122 and a deflectable shroud 124 that extends between the connector housing 120 and the compressible gasket 122. The connector assembly 112 is mounted to a wall or panel 126 and extends through an opening 128 in the panel 126.

The connector housing 120 includes a mating end 134 and a cable end 136. The shroud 124 extends rearward from the cable end 136. In an exemplary embodiment, the shroud 124 is formed integral with the connector housing 120. For example, living hinges 138 may be provided between the connector housing 120 and the shroud 124. The shroud 124 is pivoted about the living hinges 138. The shroud 124 is co-molded with the connector housing 120 and the living hinges 138. Alternatively, the shroud 124 may be separate from the connector housing 120 and coupled thereto.

The gasket 122 may be substantially similar to the gasket 22 described above. The gasket 122 is compressible and may be compressed to fit through the opening 128 and then may expand to fill the opening 128.

The deflectable shroud 124 extends between the connector housing 120 and the gasket 122. The shroud 124 is deflectable between an expanded state and a collapsed state. The shroud 124 has a smaller outer perimeter in the collapsed state as compared to the expanded state. The shroud 124 is normally in the expanded state and is deflected to the collapsed state during loading of the connector assembly 112 through the panel 126. Once the shroud 124 passes through the panel 126, the shroud 124 returns to the expanded state.

The shroud 124 extends between a forward end 160 and a rearward end 162. In an exemplary embodiment, the shroud 124 includes a first wing 164 and a second wing 166 that are movable relative to one another. Optionally, both the first and second wings 164, 166 are movable. Alternatively, only one of the wings 164 or 166 are movable. A hollow chamber 168 is defined by the shroud 124 between the first and second wings 164, 166 and between the forward and rearward ends 160, 162. A portion of the gasket 122 is received within the hollow chamber 168.

In an exemplary embodiment, the first and second wings 164, 166 are each connected to the connector housing 120 at a corresponding living hinge 138 at the forward end 160 thereof. The first and second wings 164, 166 are cantilevered from the connector housing 120 such that the first and second wings 164, 166 are free floating at the rearward ends 162. The first and second wings 164, 166 are separate components from one another and are movable with respect to one another.

The first and second wings 164, 166 each include a plate 174 and side walls 176 extending generally perpendicular from the plate 174. The plates 174 are connected to the connector housing 120 at the living hinges 138. The plates 174 are oriented on opposite sides of the shroud 124 from one another. The side walls 176 are not connected to the connector housing 120, but rather are movable along the connector housing 120 as the shroud is deflected between the expanded and collapsed states. The side walls 176 may at least partially overlap one another, and the overlapped portions may move relative to one another.

The first and second wings 164, 166 may include arms 180, 182, respectively, at the rearward ends 162 of the shroud 124. The arms 180, 182 are configured to abut against the panel 126 when the connector assembly 12 is finally assembled. The first and second wings 164, 166 include windows 184 therethrough allowing visual inspection of the hollow chamber 168. Additionally, wires, such as a ground wire may pass through the one of the windows 184.

Figure 6:
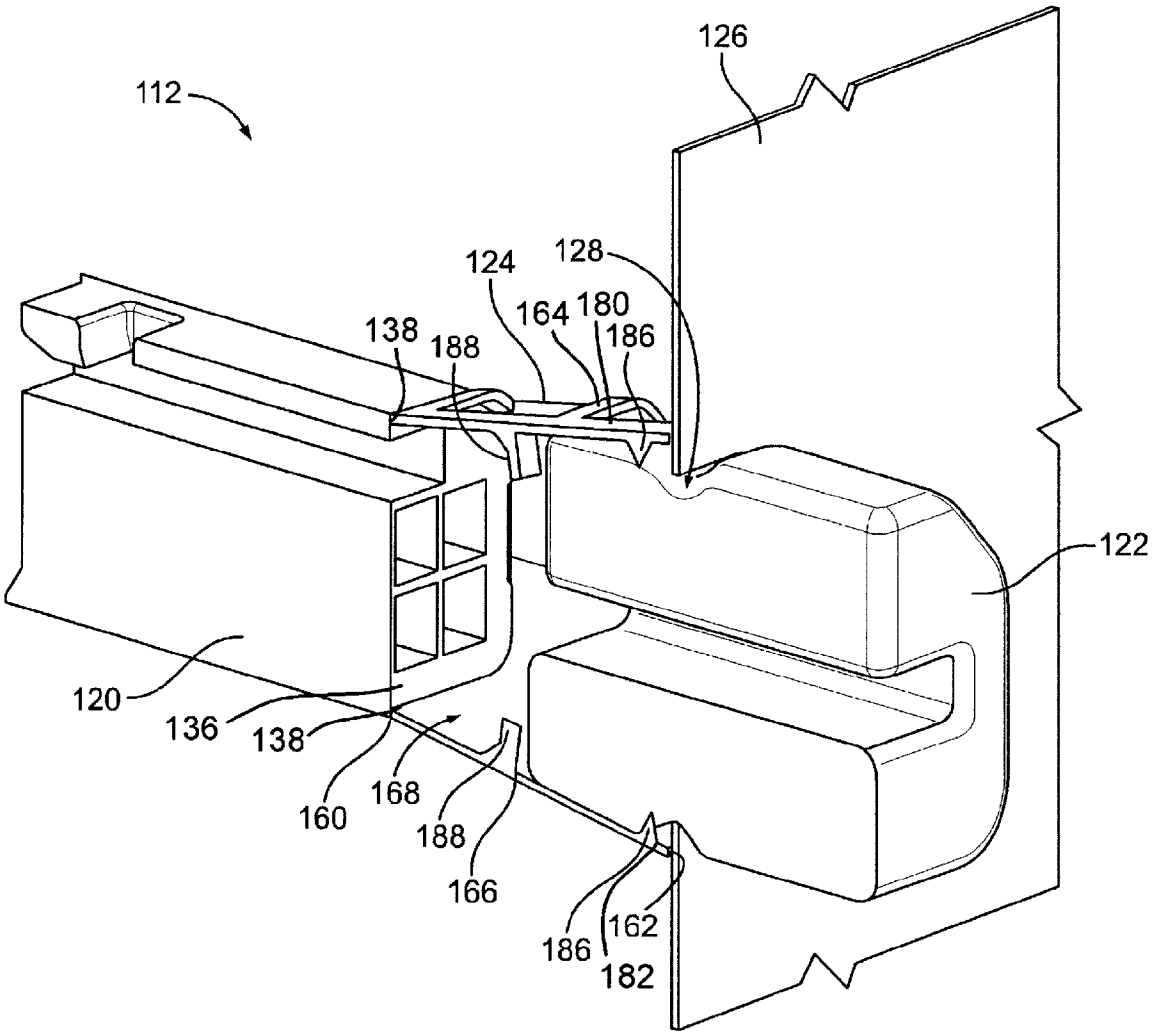
FIG. 6 is a rear perspective, partial cutaway view of the connector assembly shown in FIG. 5 in an expanded state.
Figure 7:
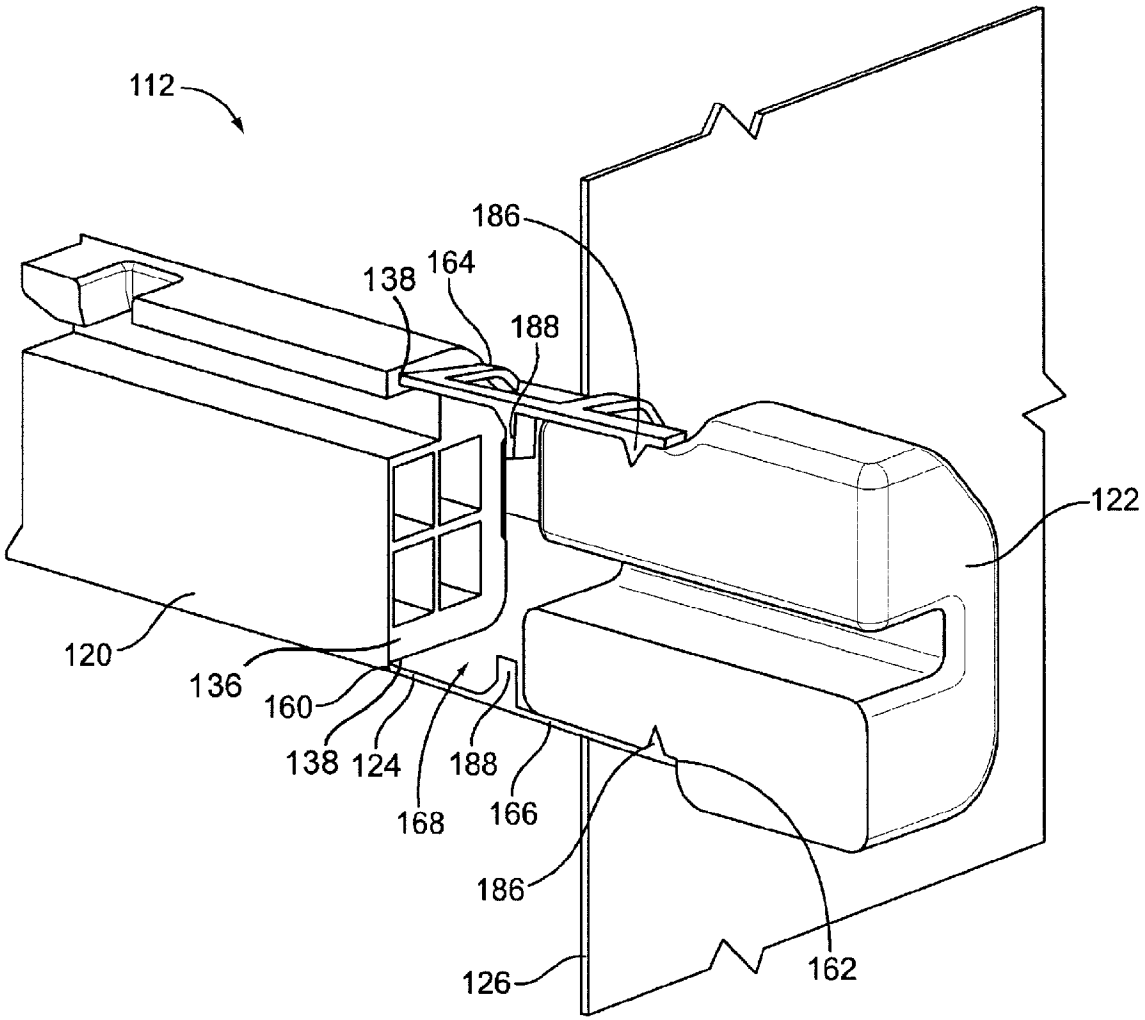
FIG. 7 is a rear perspective, partial cutaway view of the connector assembly shown in FIG. 5 in a collapsed state.

FIG. 6 is rear perspective, partial cutaway view of the connector assembly 112 in an expanded state. FIG. 7 is a rear perspective, partial cutaway view of the connector assembly 112 in a collapsed state. During assembly, the connector assembly 112 is loaded through the opening 128 until the connector housing 120 and the shroud 124 are positioned forward of the panel 126. FIG. 7 shows the connector assembly 112 being loaded through the opening 128.

During loading, the shroud 124 is deflected to the collapsed state by interaction with the opening 128. In the collapsed state, the shroud 124 compresses the gasket 122 so that the gasket 122 is able to be squeezed through the opening 128. The shroud 124 thus functions as a lead-in feature for loading the gasket 122 into the opening 128. Once the shroud 124 passes through the opening 128, the shroud 124 returns to the expanded state and the connector assembly 112 is coupled to the panel 126. The gasket 122 is also able to return to an expanded condition when the shroud 124 is deflected to the expanded state.

As shown in FIGS. 6 and 7, a volume of the hollow chamber 168 is changed as the shroud 124 is transitioned between the expanded state and the collapsed state. In the expanded state, the hollow chamber 168 is generally pie-shaped, with the rearward end 162 being wider than the forward end 160. The first and second wings 164, 166 are angled outward from a central longitudinal axis of the connector assembly 112. In the collapsed state, the hollow chamber 168 is generally box-shaped, with the rearward end 162 being approximately the same width as the forward end 160. The first and second wings 164, 166 are generally parallel to one another and parallel to the central longitudinal axis of the connector assembly 112. Optionally, the hollow chamber 168 may be reduced in volume by at least 10% as the shroud 124 is deflected to the collapsed state.

The first and second wings 164, 166 include retention barbs 186 extending inward into the hollow chamber 168. The retention barbs 186 are configured to bite into the gasket 122 to secure the shroud 124 to the gasket 122. In an exemplary embodiment, the first and second wings 164, 166 include flanges 188 that extend inward into the hollow chamber 168. The flanges 188 define stops that control a loading depth of the gasket 122 into the hollow chamber 168.

Figure 8:
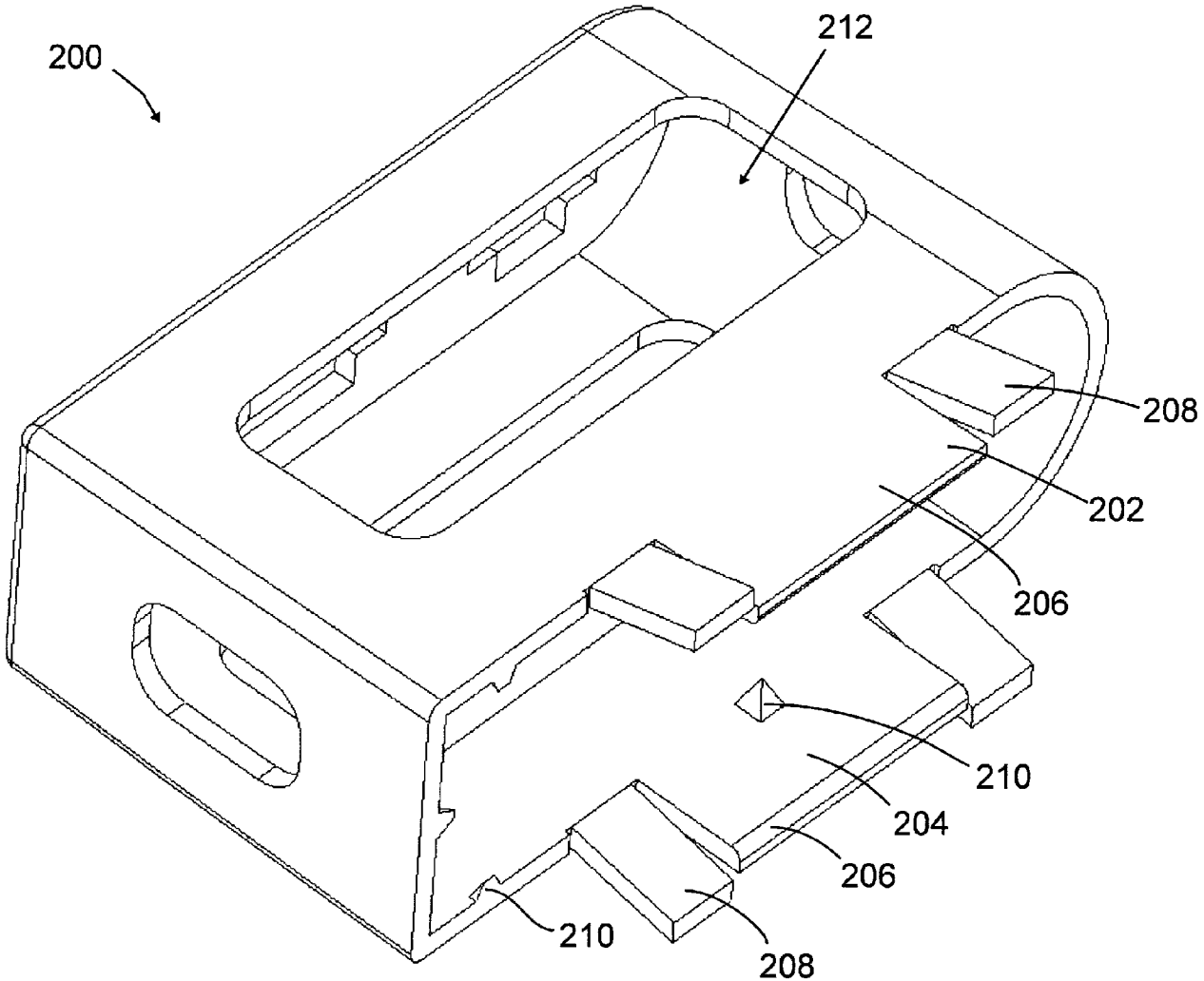
FIG. 8 is a rear perspective view of another alternative shroud.

FIG. 8 is a rear perspective view of another alternative shroud 200. The shroud 200 may be used with one or more connectors (not shown). The shroud 200 may be coupled to a connector housing of the connector and to a compressible gasket (not shown). The shroud 200 may be mounted to a wall or panel and may extend through an opening in the panel in a similar fashion as the connector assembly 12. The shroud 200 functions as a cover for a portion of the gasket. The shroud 200 functions as a supporting structure for the connector and holds the connector relative to the panel for mating with a mating connector. The shroud 200 prevents the connector from backing up relative to the panel and generally holds the connector in place.

The shroud 200 is deflectable between an expanded state and a collapsed state. The shroud 200 may be at least partially expanded when the gasket is loaded into the rear of the shroud 200. For example, the rear portion of the shroud 200, which surrounds the gasket, may be partially deflected outward when the gasket is loaded therein. The gasket may be compressed to allow the gasket to be loaded into the shroud 200. Once loaded, the gasket may partially expand back toward its original shape against the inner surfaces of the shroud 200. As the shroud 200 passes through the panel, the shroud 200 may be at least partially collapsed.

The shroud 200 a first wing 202 and a second wing 204 that are movable relative to one another. The first and second wings 202, 204 are both connected to the frame of the shroud 200 and extend rearward therefrom. The first and second wings 202, 204 each include a main arm 206 and panel retention clips 208 that are deflectable with respect to the main arm 206. The panel retention clips 208 and/or the main arms 206 may be deflected to a compressed state as the shroud 200 is loaded through the opening in the panel. When the main arms 206 and the panel retention clips 208 are deflected, they are moved relatively closer to one another and compress the gasket. Such deflection may compress the gasket as the gasket is simultaneously loaded through the opening. Once the main arms 206 and the panel retention clips 208 clear the opening, the main arms 206 and/or the panel retention clips 208 expand outward and engage the panel. The panel retention clips 208 engage the panel to resist removal of the shroud 200 through the opening. Optionally, as in the illustrated embodiment, the shroud 200 may have retention barbs 210 that extend inward. The retention barbs 210 are configured to engage the gasket.

Optionally, the frame of the shroud 200 may have slits cut in the side walls thereof that allow the main arms 206 to compress further toward one another. Such slits may extend from the rear end of the shroud 200 forwardly for a horizontal distance. The slits may have a vertical width. The distance and the width may control an amount of collapse of the shroud 200. The shroud 200 may include windows 212 therethrough allowing visual inspection of the gasket and the wires extending through the gasket to the connector held by the shroud 200. Additionally, wires may pass through the one of the windows 212.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for use with a compressible gasket, the connector assembly comprising:

a housing having a mating end and a cable end, the housing being configured to hold a contact; and a deflectable shroud extending from the housing rearward of the cable end to the compressible gasket, the shroud surrounding a hollow chamber configured to receive the compressible gasket, the shroud being configured to be coupled to the gasket, the shroud supporting the housing such that the cable end of the housing is spaced apart from the gasket, the shroud being deflectable between an expanded state and a collapsed state, wherein a volume of the hollow chamber is reduced when in the collapsed state as compared to the expanded state, the shroud being able to compress the gasket when in the collapsed state.

2. The connector assembly of claim 1, wherein the shroud has a forward end and a rearward end, the forward end being connected to the housing, the rearward end being configured to engage the gasket, the shroud pivoting about the forward end to change a relative position of the rear end.

3. The connector assembly of claim 1, wherein the shroud has a forward end and a rearward end, the forward end being connected to the housing, the rearward end being configured to engage the gasket, when in the expanded state, the rear end defining a height that is taller than the forward end, when in the collapsed state, the rear end defining a height that is substantially the same as the forward end.

4. The connector assembly of claim 1, wherein the shroud includes a first wing and a second wing, the first wing being movable relative to the second wing to increase or decrease the volume of the hollow chamber.

5. The connector assembly of claim 1, wherein the connector assembly and the gasket are configured to be loaded through an opening in a panel, the opening in the panel having a perimeter that is smaller than a perimeter of the shroud, wherein the shroud is configured to be deflected to the collapsed state when the shroud passes through the opening, and wherein the shroud is configured to compress the gasket when the shroud passes through the opening.

6. The connector assembly of claim 1, wherein the shroud includes a first wing and a second wing, the first and second wings extending rearward from the housing to rearward ends, the rearward ends being separated by a distance, the distance changing by more than 10% as the shroud is deflected between the expanded and collapsed states.

7. The connector assembly of claim 1, wherein the shroud includes a window therethrough.

8. The connector assembly of claim 1, wherein the shroud includes a barb extending into the hollow chamber, the barb being configured to engage the gasket to secure the shroud to the gasket.

9. A connector assembly for use with a compressible gasket, the connector assembly comprising:

a housing having a mating end and a cable end, the housing being configured to hold a contact; and a deflectable shroud extending from the housing rearward of the cable end to the compressible gasket, the shroud being coupled to the housing at a living hinge formed integral with the housing, the shroud surrounding a hollow chamber configured to receive the compressible gasket, the shroud being deflectable between an expanded state and a collapsed state, wherein a volume of the hollow chamber is reduced when in the collapsed state as compared to the expanded state, the shroud being able to compress the gasket when in the collapsed state.

10. The connector assembly of claim 9, wherein the shroud has a forward end and a rearward end, the forward end being connected to the housing, the rearward end being configured to engage the gasket, the shroud pivoting about the forward end to change a relative position of the rear end.

11. The connector assembly of claim 9, wherein the shroud has a forward end and a rearward end, the forward end being connected to the housing, the rearward end being configured to engage the gasket, when in the expanded state, the rear end defining a height that is taller than the forward end, when in the collapsed state, the rear end defining a height that is substantially the same as the forward end.

12. The connector assembly of claim 9, wherein the shroud is configured to be coupled to the gasket, the shroud supporting the housing such that the cable end of the housing is spaced apart from the gasket.

13. A connector assembly for use with a compressible gasket, the connector assembly comprising:

a housing having a mating end and a cable end, the housing being configured to hold a contact; and a deflectable shroud extending from the housing rearward of the cable end to the compressible gasket, the shroud surrounding a hollow chamber configured to receive the compressible gasket, the shroud having a forward end and a rearward end, the forward end being connected to the housing, the rearward end being configured to engage the gasket, the shroud pivoting about the forward end to change a relative position of the rear end, the shroud having a first wing and a second wing, the first wing being movable with respect to the second wing to increase or decrease a volume of the hollow chamber, the shroud being able to compress the gasket when the first wing is moved relatively closer to the second wing.

14. The connector assembly of claim 13, when in the expanded state, the rearward end defining a height that is taller than the forward end, when in the collapsed state, the rearward end defining a height that is substantially the same as the forward end.

15. The connector assembly of claim 13, wherein the connector assembly and the gasket are configured to be loaded through an opening in a panel, the opening in the panel having a perimeter that is smaller than a perimeter of the shroud, wherein the shroud is configured to be deflected to the collapsed state when the shroud passes through the opening, and wherein the shroud is configured to compress the gasket when the shroud passes through the opening.

16. The connector assembly of claim 13, wherein the shroud includes a window therethrough.

17. A method of mounting a connector assembly to a panel having an opening, the method comprising:

providing a compressible gasket having a channel therethrough;

providing a connector housing with a deflectable shroud extending from the connector housing, the deflectable shroud defining a hollow chamber;

positioning the gasket within the hollow chamber and collapsing the shroud onto the gasket; and loading the connector housing and gasket through the opening in the panel by simultaneously passing the gasket and a portion of the shroud through the opening until the shroud clears the opening, wherein the shroud is collapsed as the shroud passes through the panel opening, and wherein the shroud compresses the compressible gasket as the shroud is collapsed, the connector housing and gasket being loaded through the opening until the gasket is aligned with the opening.

18. The method of claim 17, wherein said loading the connector housing and gasket through the opening in the panel comprises loading the shroud through the opening until the shroud clears the opening, wherein the shroud automatically moves to an expanded state after the shroud clears the opening such that a rearward end of the shroud engages the panel.

19. The method of claim 17, wherein said providing a connector housing with a deflectable shroud further comprises providing a connector housing with a deflectable shroud having first and second wings being flared outward from a forward end to a rearward end having a larger perimeter than the forward end, and wherein said loading the connector housing and gasket through the opening in the panel comprises loading the shroud through the opening such that the first and second wings interfere with the opening and are forced inward toward one another by the opening, the first and second wings compressing the gasket as the first and second wings are forced inward.

20. The method of claim 17, further comprising:

loading a wire with a contact at an end of the wire into the channel; and loading the contact into the housing.

* * * * *